US005238239A

United States Patent [19]

LaChapelle

[11] Patent Number: 5,238,239

[45] Date of Patent: Aug. 24, 1993

[54] CARTON BLANK PREFEEDING APPARATUS AND PROCESS

[75] Inventor: Philip S. LaChapelle, Tega Cay, S.C.

[73] Assignee: Roberts Systems, Inc., Charlotte, N.C.

[21] Appl. No.: 775,711

[22] Filed: Oct. 11, 1991

[51] Int. Cl.[5] ..... B65H 5/02

[52] U.S. Cl. ..... 271/275; 271/200; 271/171

[58] Field of Search ..... 271/10, 16, 23, 151, 271/209, 216, 264, 275, 6, 162, 171, 200, 203; 198/861.2; 414/794.5, 794.6

[56] References Cited

U.S. PATENT DOCUMENTS

| | | | |
|---|---|---|---|
| 2,880,998 | 4/1959 | Middleton et al. | 271/272 |
| 3,522,943 | 4/1970 | Swanson | 271/6 |
| 3,674,258 | 7/1972 | Maier, Jr. et al. | 271/200 X |
| 4,177,982 | 12/1979 | Bewersdorf et al. | 271/6 X |
| 4,180,259 | 12/1979 | Bewersdorf et al. | 271/200 |
| 4,237,677 | 12/1980 | Klapp | 271/200 X |
| 4,240,539 | 12/1980 | Klapp | 271/216 X |
| 4,265,443 | 5/1981 | Berthelot | 271/200 X |
| 4,436,297 | 3/1984 | Chandhoke | 271/171 X |
| 4,667,953 | 5/1987 | Hirakawa et al. | 271/216 X |
| 4,783,065 | 11/1988 | Graves, Sr. | 271/209 X |
| 5,088,711 | 2/1992 | Newsome | 271/216 X |

*Primary Examiner*—H. Grant Skaggs
*Assistant Examiner*—Carol Lynn Druzbick
*Attorney, Agent, or Firm*—Hardaway Law Firm

[57] ABSTRACT

A carton blank prefeeding apparatus generally comprising a carton blank stack magazine situated above a conveyor. The conveyor is preferably tri-sectional, having a blank withdrawal section, an intermediate section and a delivery section. Typically, the blank withdrawal section and the delivery section are pivotally attached to the supporting subframe, thus allowing adjustment of the relative angles of inclination between successive conveyor sections. An upper conveyor may be situated above the delivery section to cooperate therewith in the delivery of the blanks. A center driven pulley may be utilized to drive the tri-sectional conveyor directly, as well as the upper conveyor via an interconnecting drive belt. A pair of opposing blank flexing members situated laterally of the conveyor facilitate the removal of debris on the blanks. The process of the invention contemplates first providing a stack of carton blanks. Second, individual blanks are removed from the bottom of the stack in shingled arrangement. Next, the blanks are flexed while in the shingled arrangement such that they are convex. Then the blanks are restacked.

27 Claims, 3 Drawing Sheets 12
44
10
22
24
1A
1A
14
16

38
40
132
32
62
134
44
138
136
2A
2A
34
66
74
26
132
114
108
72
84
78
70
142
144
64
140
3
3

64
140

CARTON BLANK PREFEEDING APPARATUS AND PROCESS

BACKGROUND OF THE INVENTION

This invention relates generally to the art of packaging and more particularly to an apparatus and process of preparing a stack of carton blanks for further processing, such as by high-speed carton blank feeder.

The bayonet handle package, first seen in U.S. Pat. No. 4,986,420, issued to Gunn et al. on Jan. 21, 1991, is a significant development in the packaging and marketing of detergent powder and other particulate commodities. The package developed as a response to difficulties in the marketing of the new high density laundry detergents. Such detergents require a package with a hinged top so that the consumer can scoop relatively precise amounts of detergent each time. Since the top is hinged, it is preferable that a handle for the package be attached to the sides rather than the top itself. The bayonet handle package provides such a container.

Unlike prior art riveted handles, the bayonet handle is folded and inserted into apertures formed in the carton blank such that barbs on the ends of the handle are ensnared on the aperture lip. Attachment is therefore completely accomplished by the combination of the aperture and the shape of the handle. Since the need for a rivet or like attachment means is eliminated, the bayonet handle inherently lends itself to one more efficient manufacture.

The continuous motion handle attachment apparatus, co-pending application Ser. No. 07/670,723, was developed to exploit some of these advantages. This apparatus has proven capable of assembling such packages at an incessant rate of over 300 per minute. Obviously, a high-speed carton blank feeder is necessary to supply the individual blanks to the attachment apparatus.

Typically, however, the carton blanks are manufactured at an earlier time or at a separate facility and accumulated in upright stacks. Because of settling in the stacks due to shipping and storage, the individual blanks tend to stick. This sticking was not a great problem in the past since the packaging machinery operated at much slower speeds. The higher rates attainable with the continuous motion handle attachment apparatus and its attendant high-speed feeder have exacerbated the problem.

U.S. Pat. No. 4,369,961, issued to Gopel et al. on Jan. 25, 1983 and U.S. Pat. No. 4,192,496 issued to Baselice et al. on Mar. 11, 1980 illustrate pertinent devices. Both of these configurations, however, are of limited utility with regard to the current high-speed equipment.

Specifically, Gopel et al. contemplates individual blank delivery. It is unnecessary, and thus inefficient, to fully separate the blanks in order to "break up" the stack. Baselice et al. does illustrate delivery of the blanks in shingled arrangement, but this design has other serious deficiencies. For example, only a modest angle of inclination between the first and second conveyor sections is possible. Additionally, the device of Baselice et al. employs a now antiquated drive system. Further, no provision for the removal of glue, dust or debris from the blanks is provided.

SUMMARY OF THE INVENTION

It is thus an object of the present invention to provide a novel carton blank prefeeding apparatus.

It is a further object of the invention to provide a novel carton blank prefeeding apparatus having a greater angle of inclination and thus a shorter horizontal span than prior art devices.

It is also an object of the invention to provide a carton blank prefeeding apparatus having a novel drive configuration.

It is an additional object of the invention to provide a novel apparatus and process for the preparation of a stack of carton blanks for further processing.

Some of these, as well as other, objects are accomplished by a carton blank prefeeding apparatus generally comprising a carton blank stack magazine situated above a conveyor. The conveyor is preferably tri-sectional, having a blank withdrawal section, an intermediate section and a delivery section. Typically, the blank withdrawal section and the delivery section are pivotally attached to the supporting subframe, thus allowing adjustment of the relative angles of inclination between successive conveyor sections. An upper conveyor may be situated above the delivery section to cooperate therewith in the delivery of the blanks. A center driven pulley may be utilized to drive the tri-sectional conveyor directly, as well as the upper conveyor via an interconnecting drive belt. A pair of opposing blank flexing members situated laterally of the conveyor facilitate the removal of debris on the blanks.

The process of the invention contemplates first providing a stack of carton blanks. Second, individual blanks are removed from the bottom of the stack in shingled arrangement. Next, the blanks are flexed while in the shingled arrangement such that they are convex. Then the blanks are restacked.

DETAILED DESCRIPTION

In accordance with this invention, it has been found that a novel apparatus and process may be provided for preparing a stack of carton blanks for further processing, such as by a high-speed feeding machine. As used herein, it is understood that the term carton blank refers generally to carton outer blanks or container liners.

Figures 1, 2, 3:
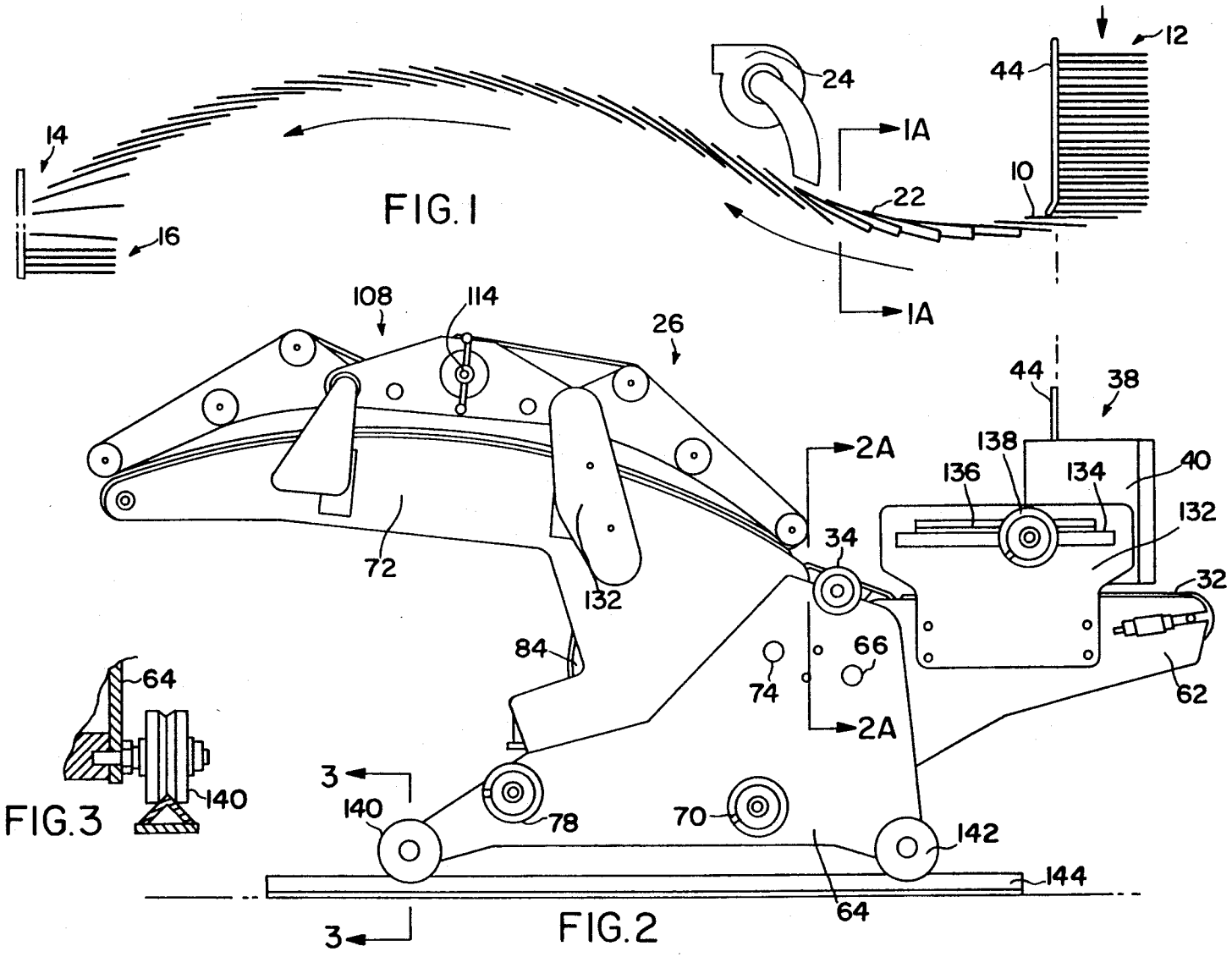
FIG. 1 is a schematic side elevation illustrating shingled delivery of carton blanks according to the present invention.
FIG. 2 is a side elevation view of an apparatus constructed in accordance with the invention.
FIG. 3 is a partial cross-sectional view along line 3—3 of FIG. 2.

As seen in FIG. 1, individual blanks, such as blank 10, are withdrawn in shingled arrangement from the bottom of a carton blank stack 12. The shingled blanks are then transported in a forward direction to a discharge location 14 where they may be restacked, forming stack 16. This shingling and restacking results in a more uniform stack pressure which is necessary for high-speed feeding equipment. An accurate blank delivery path (as seen in side elevation) further facilitates stack break-up.

Figure 1A:
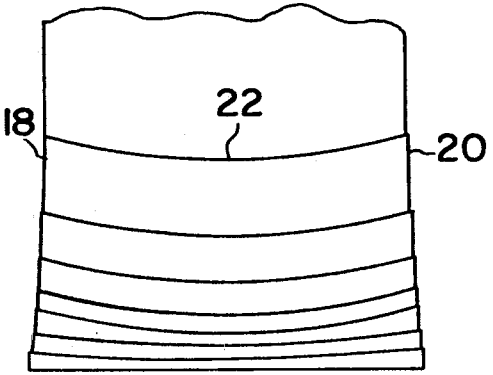
FIG. 1A is a view along line 1A—1A of FIG. 1 illustrating convex bending of the carton blanks in accordance with the invention.

In preparing a carton blank stack for use in high-speed equipment, it is also desirable that excess glue or other debris such as dust which has settled thereon be removed. This may be accomplished by upwardly flexing lateral edges of the blanks, such as edges 18 and 20 of blank 22, at a location intermediate blank withdrawal from stack 12 and restacking at location 14 such that the normally generally flat blanks are bent into a convex shape (FIG. 1A). The debris is thereby agitated and will tend to fall away. Additionally, a vacuum 24 may be utilized to further remove the loosened debris.

Figure 2A:
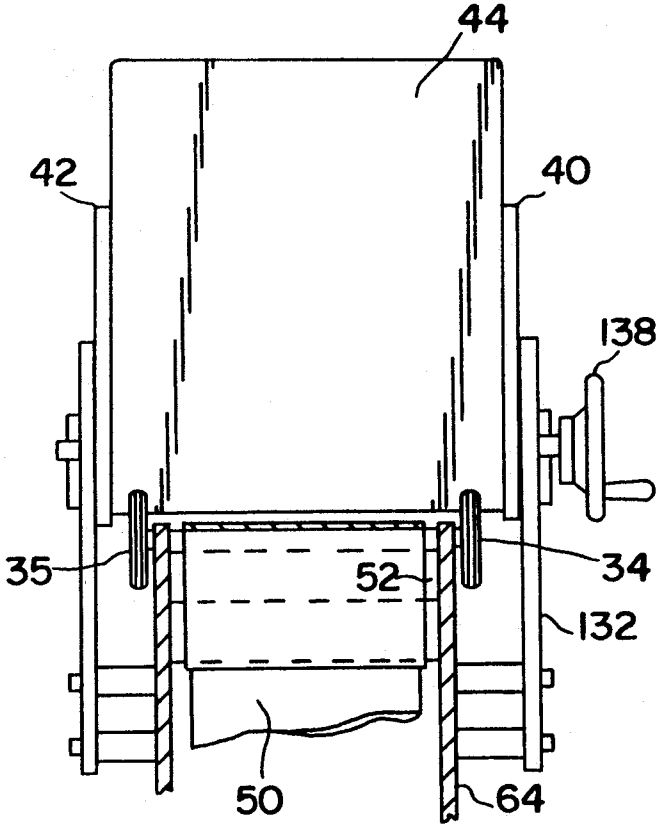
FIG. 2A is a cross-sectional view along line 2A—2A of FIG. 2 wherein the carton blanks flexing members of the apparatus are illustrated.
Figure 4:
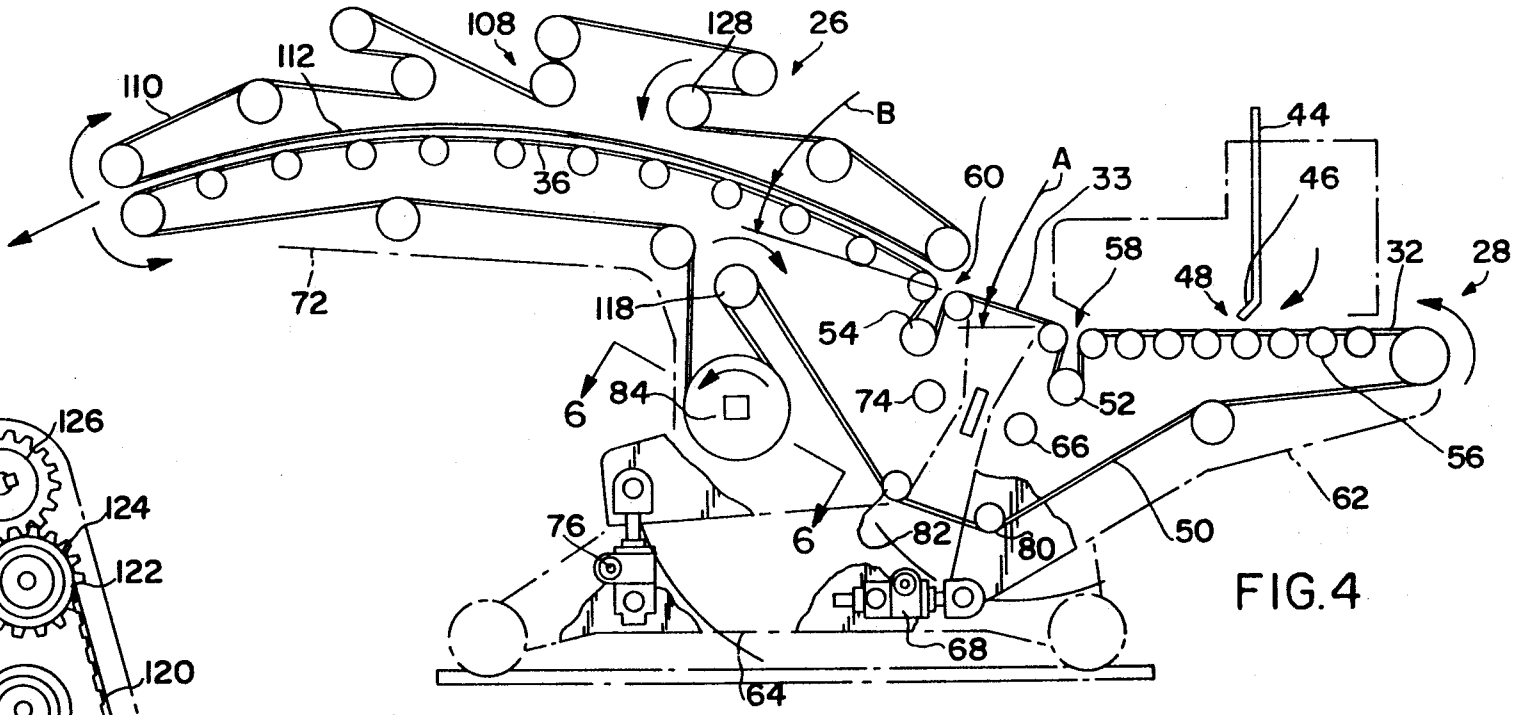
FIG. 4 is a side elevation view of the apparatus of the invention wherein outer components are shown in phantom to illustrate the internal routing of the conveyors.

FIGS. 2 and 4 illustrate a carton blank prefeeding apparatus 26 constructed in accordance with the invention. Apparatus 26 has a tri-sectional lower conveyor 28. The first section, blank withdrawal section 32 is situated below carton blank stack magazine 38. Magazine 38 comprises opposed lateral side walls 40 and 42 (FIG. 2A) and a forward gate means such as retaining wall 44. Wall 44 has a lower contoured section 46 which is forwardly curved to facilitate shingling as blanks from a stack within magazine 38 are frictionally withdrawn through transverse gap 48 by blank withdrawal conveyor section 32.

The second conveyor section, which is immediately forward the termination of blank withdrawal conveyor section 32, is intermediate conveyor section 33. Situated laterally of intermediate conveyor section are opposite blank flexing members 34 and 35. Members 34 and 35 provide raised surfaces to temporarily bend passing blanks into a convex shape. Preferably, members 34 and 35 should be wheels or the like to minimize friction. However, stationary members constructed of a low friction material may be used alternatively.

The third conveyor section, which is immediately forward the termination of intermediate conveyor section 33, is arcuate delivery conveyor section 36.

Preferably, conveyor 28 comprises a single conveyor belt 50. The three conveyor sections are formed by a unique belt routing arrangement. Specifically, belt 50 is routed under a first break roller 52 and similarly under a second break roller 54. Rollers 52 and 54 are located below other conveyor rollers, such as roller 56, which support belt 50 to define the path of carton blank delivery. First break roller 52 thus marks a first break 58 in the conveyor surface that defines the termination of blank withdrawal conveyor section 32 and the beginning of intermediate conveyor section 33. Similarly, second break roller 54 marks a second break 60 in the conveyor surface that defines the termination of intermediate conveyor section 33 and the beginning of delivery conveyor section 36. It has been found that a rough-top type of belt is particularly functional as belt 50.

The unique tri-sectional configuration of conveyor 28, allows a higher possible total angle of inclination than previous devices. This total angle of inclination is the sum of angle A at break 58 and angle B at break 60. Angle A is the relative angle of inclination of the plane of intermediate conveyor section 33 with respect to blank withdrawal conveyor section 32. Angle B is similarly the relative angle of inclination of the tangent plane near the beginning of delivery conveyor section 36 with respect to intermediate section 33.

For optimum versatility, it is desirable that the total angle of inclination be adjustable within a range defined by the physical parameters of the apparatus. Thus, apparatus 26 is adapted, such that angles A & B can be individually fine tuned to suit a particular contingency.

Adjustment of angle A is accomplished by pivotal movement of entry section frame member 62, which carries blank withdrawal conveyor section 32, about pivot 66. Pivot 66 is journalled into machine subframe 64. Entry section jack 68, which is operated by handwheel 70, is provided to facilitate this movement of frame member 62. Similarly, adjustment of angle B is accomplished by the pivotal movement of discharge section frame member 72, which carries delivery conveyor section 36, about pivot 74. As with pivot 66, pivot 74 is also journalled into machine subframe 64. Discharge section jack 76, operated by handwheel 78, facilitates movement of frame member 72. Alternatively, jacks 68 and 76 could be operable by a motorized system.

Referring to FIG. 4, it is apparent that, when a single conveyor belt arrangement is utilized, any pivotal movement of either frame member 62 or frame member 72 will necessarily change the length of intermediate conveyor section. Due to symmetrical geometry about pivots 66 and 74, however, a concomitant opposite change in the length of belt 50 between rollers 80 and 82 compensates for these variations. Thus, overall tautness in belt is maintained.

To prevent problems due to slight speed differentials and for improved efficiency, it is preferable that the means provided for driving conveyor 28 comprise a single drive motor. In the single lower belt arrangement as illustrated, a center driven roller 84 may be utilized as the drive motor. This configuration has the additional advantage of minimizing the overall width of apparatus 26.

Figure 6:
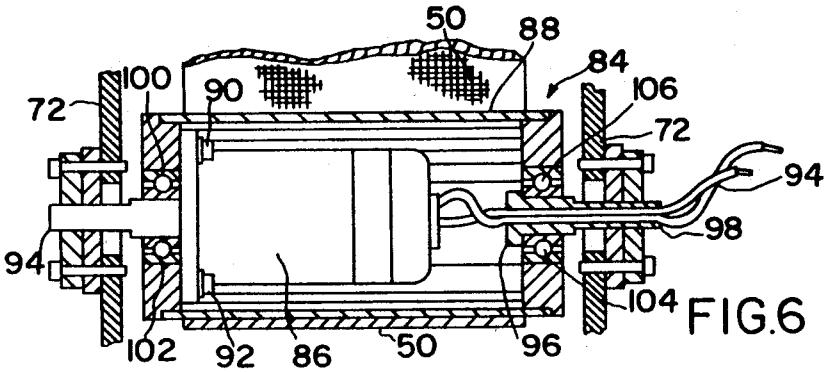
FIG. 6 is a partial cross-sectional view along line 6—6 of FIG. 4 illustrating the interior components of the center-driven pulley of the invention.

Referring specifically now to FIG. 6, roller 84 comprises an electric motor 86 housed within roller housing 88 and fixedly mounted thereto, such as by bolts 90 and 92. Motor 86 may additionally include internal gear reduction still housed within housing 88 such as the type DD11 2-stage gear box. Motor shaft 94 is secured to discharge section frame member 72. Similarly, mounting shaft 98 is also secured to frame member 72. Shaft 98 has a longitudinal base 96 through which motor wiring 94 exits to a source of electricity. Thus operation of motor 86 rotates roller 88 about shafts 94 and 98. Bearings, such as bearings 100, 102, 104 and 106 minimize rotational friction. As shown in FIG. 4, belt 50 is routed to contact roller housing 88 on at least 180 degrees of its surface. This minimizes the opportunity for belt slipping.

An upper conveyor, or "trap" 108, superposes delivery conveyor section 36 to further facilitate the shingled delivery of blanks to discharge. Trap 108 comprises a single upper conveyor belt 110 which has an arcuate lower section 112 complementary to the arc of delivery conveyor section 36. Adjustment handle 114 is provide so that an operator can tailor the tautness of belt 110.

Figure 5:
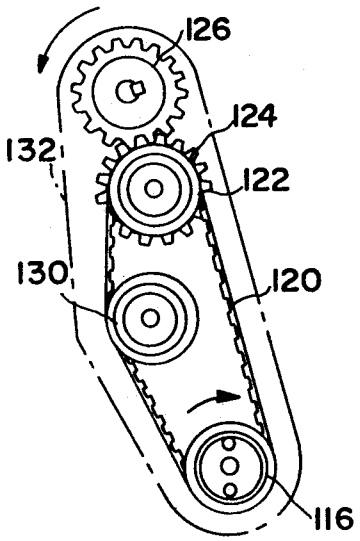
FIG. 5 is a fragmentary elevational view of the interconnecting means for driving the upper conveyor via the lower conveyor drive motor.

To prevent speed differentials between belt 110 and lower belt 50, belt 110 is indirectly driven by roller 84. In some cases it may be desirable to have a slight speed differential which can easily be achieved through gearing changes. A speed differential may help to further singulate difficult blanks. Referring to FIG. 5, pulley 116, which is attached to the end of roller 118, (FIG. 4), turns in a clockwise direction due to the movement of belt 50. Toothed drive belt 120 thereby turns pulley 122 in a clockwise direction. Pulley 122 is attached to an adjacent coaxial gear 124 which engages gear 126, driving it in a counterclockwise direction. Since gear 126 is attached to the end of roller 128, belt 110 is driven thereby. A tension pulley, such as 130, may be used to maintain tautness in drive belt 120. For safety reasons, the whole upper belt drive assembly is housed under cover 132 (FIG. 2). The change in direction from clockwise at roller 118 to counterclockwise at roller 128 is necessary. Otherwise, lower section 112 of belt 110 would oppose delivery conveyor section 36 of lower conveyor 28.

Referring again to FIG. 2, other features of apparatus 26 will be described. To accommodate various sizes of carton blanks, magazine 38 is horizontally adjustable. Specifically, magazine supporting bracket 132, which is attached to entry section frame member 62, defines a guide slot 134 having teeth along the upper edge 136 thereof. These teeth engage a pinion attached to crank wheel 138.

To facilitate forward and backward movement of apparatus 26 to accommodate different associated equipment, subframe 64 is equipped with a plurality of supporting wheels, such as wheels 140 and 142. As can be seen more clearly with reference to FIG. 3, the wheels are configured to side upon longitudinal parallel rails, such as rail 144, which are mounted to a supporting subsurface, such as a factory floor.

It is thus seen that a novel carton blank prefeeding apparatus has been provided. It can further be seen that a novel process and apparatus has been provided for the preparation of a stack of carton blanks for further processing. Many variations will undoubtedly become apparent to one skilled in the art upon a reading of the above specification with reference to the drawings. Such variations, however, are within the spirit and scope of the invention as defined by the following appended claims.

That which is claimed:

1. A carbon blank feeding apparatus for the withdrawal of generally flat carton blanks from a bottom of a carton blank stack and the delivery of said blanks in shingled arrangement in a forward direction to discharge for further processing, said apparatus comprising:

a supporting subframe;

a conveyor for moving the blanks in said forward direction, said conveyor comprising, in series, a blank withdrawal conveyor section, an intermediate conveyor section disposed at an acute angle of inclination relative to the blank withdrawal conveyor section, a delivery conveyor section carried upon a discharge section frame member pivotally attached to said subframe such that said delivery conveyor section may be pivoted relative to the intermediate conveyor section resulting in a lesser or greater relative angle of inclination therewith;

a carton blank stack magazine above said blank withdrawal conveyor section, said magazine comprising a pair of lateral side walls and a forward gate means;

said gate means defining a transverse gap over said blank withdrawal conveyor section for allowing blanks to be withdrawn by said blank withdrawal conveyor section in shingled arrangement; and means for driving said conveyor.

2. The apparatus according to claim 1 wherein said blank withdrawal conveyor section is carried upon an entry section frame member pivotally attached to said subframe such that said blank withdrawal conveyor section may be pivoted relative to the intermediate conveyor section resulting in a lesser or greater relative angle of inclination therewith.

3. The apparatus according to claim 2 including a first jack operated by a first hand crank for pivotally adjusting said discharge section frame member and a second jack operated by a second hand crank for pivotally adjusting said entry section frame member.

4. The apparatus according to claim 1 further including an arcuate upper conveyor section superposed and complementary to said delivery conveyor section for cooperating therewith to facilitate delivery of said blanks to discharge.

5. The apparatus according to claim 1 further comprising a first blank flexing member lateral said conveyor and a second blank flexing member lateral said conveyor opposite said first flexing member for temporarily bending the blanks in shingled arrangement to loosen individual blanks and facilitate removal of debris thereon.

6. A carton blank feeding apparatus for the withdrawal of generally flat carton blanks from a bottom of a carton blank stack and the delivery of said blanks in shingled arrangement in a forward direction to discharge for further processing, said apparatus comprising:

a supporting subframe;

a conveyor section for moving the blanks in said forward direction, said conveyor section comprising, in series, a blank withdrawal conveyor carried upon an entry section frame member pivotally attached to said subframe, an intermediate conveyor section, and a delivery conveyor section carried upon a discharge section frame member pivotally attached to said subframe;

said entry section frame member pivotally movable such that an angle of inclination from said blank withdrawal conveyor section to said intermediate conveyor section may be adjusted;

said discharge section frame member pivotally movable such that an angle of inclination from said intermediate conveyor section to said delivery conveyor section may be adjusted;

a carton blank stack magazine attached to said entry section frame member and located above said blank withdrawal conveyor section, said magazine comprising a pair of lateral side walls and a forward gate means;

said gate means defining a transverse gap over said blank withdrawal conveyor section for allowing blanks to be withdrawn by said blank withdrawal conveyor section in shingled arrangement; and means for driving said conveyor.

7. The apparatus according to claim 6 wherein said means for driving said conveyor is a single drive motor.

8. The apparatus according to claim 7 further including an upper conveyor section superposed said delivery conveyor section for cooperating therewith to facilitate delivery of said blanks to discharge, said upper conveyor section driven by said single drive motor.

9. The apparatus according to claim 6 wherein said conveyor comprises a continuous conveyor belt having a plurality of belt rollers including a first break roller located below a path of blank delivery for engaging said conveyor belt to define a first break therein between the blank withdrawal conveyor section and the intermediate conveyor section and further including a second break roller similarly located below the path of blank delivery for engaging said conveyor belt to define a second break therein between the immediate conveyor section and the delivery conveyor section.

10. The apparatus according to claim 6 further comprising a first blank flexing member lateral said conveyor and a second blank flexing member lateral said conveyor opposite the first flexing member for temporarily bending the blanks in shingled arrangement to loosen individual blanks and facilitate removal of debris thereon.

11. The apparatus according to claim 10 wherein said flexing members are wheels.

12. The apparatus according to claim 6 including a first jack operated by a first hand crank for pivotally adjusting said discharge section frame member and a second jack operated by a second hand crank for pivotally adjusting said entry section frame member.

13. A carton blank feeding apparatus for the withdrawal of generally flat carton blanks from a bottom of a carton blank stack and the delivery of said blanks in shingled arrangement in a forward direction to discharge for further processing, said apparatus comprising:

a supporting subframe;

a lower conveyor belt for moving the blanks in forward direction said lower belt supported by a pair of break rollers;

a carton blank stack magazine comprising a pair of lateral side walls and a forward gate means;

said gate means defining a transverse gap over said lower conveyor belt for allowing blanks to be withdrawn by said lower conveyor belt in shingled arrangement;

said subframe providing means for pivotal movement of said break rollers relative to said carton blank stack magazine thereby permitting adjustments of said lower belt relative to said magazine;

an upper conveyor forward said gate means partially superposing said lower conveyor belt for cooperating therewith to facilitate delivery of said blanks to discharge;

a single drive motor for driving said lower conveyor belt and said upper conveyor.

14. The apparatus according to claim 13 wherein said single drive motor is a center driven pulley engaging said lower conveyor belt, said center driven roller driving said upper conveyor via an interconnecting drive belt.

15. The apparatus according to claim 13 further comprising a first blank flexing member lateral said lower conveyor belt and a second blank flexing member lateral said lower conveyor belt opposite said first flexing member for temporarily bending the blanks in shingled arrangement to loosen individual blanks and facilitate removal of debris thereon.

16. The apparatus according to claim 15 wherein said flexing members are wheels.

17. The apparatus according to claim 15 wherein said flexing members are wheels.

18. A carton blank feeding apparatus for the withdrawal of generally flat carton blanks from a bottom of a carton blanks stack and the delivery of said blanks in shingled arrangement in a forward direction to discharge for further processing, said apparatus comprising:

a supporting subframe;

a lower conveyor belt for moving the blanks in forward direction said lower belt supported by a pair of break rollers;

a carton blank stack magazine comprising a pair of lateral side walls and a forward gate means;

said gate means defining a transverse gap over said lower conveyor belt for allowing blanks to be withdrawn by said lower conveyor in shingled arrangement;

said subframe providing means for pivotal movement to said break rollers relative to said carton blank stack magazine thereby permitting adjustments of said lower belt relative to said magazine;

means for driving said lower conveyor belt;

a first blank flexing member lateral said lower conveyor belt and a second blank flexing member lateral said lower conveyor belt opposite said first flexing member for temporarily bending the blanks in shingled arrangement to loosen individual blanks and facilitate removal of debris thereon.

19. The apparatus according to claim 18 wherein said means for driving said lower conveyor belt is a single drive motor.

20. The apparatus according to claim 19 further comprising an upper conveyor forward said gate means partially superposing said lower conveyor belt for cooperating therewith to facilitate delivery of said blanks to discharge, said upper conveyor driven by said single drive motor via an interconnecting drive belt.

21. A carton blank feeding apparatus for the withdrawal of generally flat carton blanks from a bottom of a carton blank stack and the delivery of said blanks in shingled arrangement in a forward direction to discharge for further processing, said apparatus comprising:

a supporting subframe;

an entry section frame member pivotally attached to said subframe;

a discharge section frame member pivotally attached to said subframe;

a lower conveyor for moving the blanks in said forward direction, said conveyor comprising a conveyor belt engaging a first break roller located below path of blank delivery to define a first transverse break in said conveyor and further engaging a second break roller similarly located below the path of blank delivery to define a second transverse break in said conveyor, wherein said conveyor has a blank withdrawal conveyor section carried by said entry section frame member and terminating at said first transverse break and a delivery conveyor section beginning at said second transverse break and carried by said discharge section frame member;

a carton blank stack magazine attached to said entry section frame member above said blank withdrawal conveyor section, said magazine having a forward gate means defining a transverse gap over said blank withdrawal conveyor section for allowing blanks to be withdrawn by said lower conveyor in shingled arrangement;

a center driven roller engaging said conveyor belt for driving said lower conveyor.

22. The apparatus according to claim 21 further comprising an upper conveyor superposed said delivery conveyor section for cooperating therewith to facilitate delivery of said blanks to discharge, said upper conveyor driven by said center driven roller via an interconnecting drive belt.

23. The apparatus according to claim 21 further comprising a first blank flexing member lateral said lower conveyor and a second blank flexing member lateral said lower conveyor opposite said first blank flexing member for temporarily bending the blanks in shingled arrangement to loosen individual blanks and facilitate removal of debris thereon.

24. The apparatus according to claim 23 wherein said flexing members are wheels.

25. The apparatus according to claim 21 wherein said conveyor belt is a rough-top belt.

26. The apparatus according to claim 21 including a first hand crank for pivotally adjusting said discharge section frame member and a second hand crank for pivotally adjusting said entry section frame member.

27. The apparatus according to claim 21 including means for enabling forward and backward movement of said apparatus, said means comprising configured wheels attached to said subframe and a pair of parallel rails.

* * * * *